US005385304A

United States Patent [19]

Haruch

[11] Patent Number: 5,385,304

[45] Date of Patent: Jan. 31, 1995

[54] AIR ASSISTED ATOMIZING SPRAY NOZZLE

[75] Inventor: James Haruch, Naperville, Ill.

[73] Assignee: Spraying Systems Co., Wheaton, Ill.

[21] Appl. No.: 119,889

[22] Filed: Sep. 10, 1993

Related U.S. Application Data

[63] Continuation of Ser. No. 871,833, Apr. 20, 1992, abandoned.

[51] Int. Cl.[6] ..... B05B 7/04

[52] U.S. Cl. ..... 239/431; 239/429; 239/434

[58] Field of Search ..... 239/429–431, 239/433, 434

[56] References Cited

U.S. PATENT DOCUMENTS

| | | | |
|---|---|---|---|
| 3,088,681 | 5/1963 | McCutcheon, Jr. | 239/431 |
| 3,558,063 | 1/1971 | Goff | 239/431 |
| 4,349,156 | 9/1982 | Haruch et al. | 239/432 |
| 4,625,916 | 12/1986 | Nieuwkamp et al. | 239/431 |
| 4,645,127 | 2/1987 | Emory et al. | 239/299 |
| 4,815,665 | 3/1989 | Haruch | 239/432 |
| 4,899,937 | 2/1990 | Haruch | 239/289 |
| 5,082,185 | 1/1992 | Evans | 239/416.5 |

FOREIGN PATENT DOCUMENTS

| | | | |
|---|---|---|---|
| 810733 | 3/1937 | France | 239/431 |
| 1303471 | 8/1962 | France | 239/431 |

OTHER PUBLICATIONS

Gold Crest ® Actisol ® Compact Unit Product Literature, Roussel Bio Corporation, Jacksonville, Fla. 33224, Jan. 1990.

Gold Crest ® Actisol ® Commercial Unit Product Literature, Roussel Bio Corporation, Jacksonville, Fla. 33224, Jan. 1990.

*Primary Examiner*—Karen B. Merritt

*Attorney, Agent, or Firm*—Leydig, Voit & Mayer, Ltd.

[57] ABSTRACT

An air assisted atomizing spray nozzle including: (a) a mixing chamber, (b) a liquid inlet opening for injecting a liquid stream axially into the mixing chamber, (c) a pair of air inlet openings for injecting a pair of air streams radially into the mixing chamber in directions substantially opposed to one another and substantially perpendicular to the liquid stream for atomizing the liquid stream, and (d) an exit orifice in axial communication with the mixing chamber for discharging atomized liquid therefrom.

19 Claims, 2 Drawing Sheets

AIR ASSISTED ATOMIZING SPRAY NOZZLE

This is a continuation of copending application Ser. No. 07/871,833 filed on Apr. 20, 1992, now abandoned.

TECHNICAL FIELD

This invention is related generally to nozzles for spraying liquids, and more particularly, to improved air assisted atomizing spray nozzles.

BACKGROUND OF THE INVENTION

There are many different types of nozzles for spraying liquids. One type is a so-called air assisted atomizing spray nozzle. Such nozzles are capable of delivering a liquid in a finely divided, or atomized state. Atomization of a liquid in this type of nozzle is assisted by introducing air into the nozzle. More specifically, a liquid stream and an air stream are injected into a mixing chamber. The interaction of the air and liquid stream, among other factors, atomizes the liquid stream for discharge through an exit orifice of the nozzle.

Air assisted atomizing spray nozzles are used to apply agricultural chemicals and in other applications, such as pest control, where it is important to achieve a uniform distribution of relatively small amounts of chemicals. They also are used in humidifying systems to assure rapid evaporation of water into the atmosphere. Another use is in scrubbing systems for coal furnaces where rapid and complete chemical absorption of sulfurous gases must be optimized. In general, this type of nozzle is used in a wide variety of applications where it is important to deliver liquid in a finely atomized state.

One design for air assisted atomizing spray nozzles is shown in U.S. Pat. No. 5,082,185 to W. Evans. The nozzle shown therein is used with a hand-held spray gun which is particularly useful for applying pesticides. The air source for the gun can be either a high pressure tank or a tank which is pressurized by a hand pump. The design of the spray gun offers significant advantages, especially in that it reduces liquid leakage during shutoff. Nevertheless, the nozzle assembly shown in the above-mentioned Evans patent has room for improvement in several respects.

First, certain components of the nozzle are relatively fragile, in particular, the parts that define the mixing chamber 15 shown in FIG. 2 of the Evans patent. The spraying equipment, with which the nozzle is used, typically is carried from location to location. It also is carried by hand as pesticide is applied at a particular location. Under such circumstances, and even during assembly and repair of the nozzle, the perforated annular disk-shaped structure at the downstream end of the mixing chamber 15 may be bent or broken. Such damage, of course, can interrupt or diminish the performance of the spray nozzle.

Although durability may be less important if the nozzle is a component of a system which is more or less permanently installed, there are other problems with the design of the nozzle shown in the Evans patent. Nozzle parts very commonly are manufactured from cast or machined metal plugs, such as brass or stainless steel, which then are drilled or milled to provide the various openings and cavities. There are, however, a number of close-tolerance drillings which must be performed in order to form the mixing chamber 15 illustrated in the Evans patent. Consequently, manufacturing parts is relatively difficult and costly, and there are relatively high rejection rates during the manufacturing process.

In certain applications a spray nozzle will be used to spray highly abrasive liquids, such as limestone slurries in a smoke stack scrubbing system. Under such conditions the mixing chamber parts are subject to considerable wear. It is possible to increase the wear resistance of nozzle parts by using more wear resistant compositions, such as ceramics, but such materials must be cast or molded and cannot be readily machined. The mixing chamber part of the Evans patent, as a practical matter, cannot be adapted for use in high wear applications because the relatively complex design does not lend itself easily to casting or molding processes.

Moreover, it generally is desirable to minimize the quantity of air used to achieve a given degree of atomization of a given quantity of liquid. Improved air efficiency can permit the use of less expensive, lower capacity equipment and can lower operating costs in many systems. Air efficiency is especially important in equipment, such as that shown in the Evans patent, which relies on a portable air source. For example, the life span of high pressure tanks decreases as air consumption increases, and tanks have to be changed more frequently. If a hand pumped tank is used, work must be interrupted more frequently so that the tank can be pumped up.

The atomization process in this type of spray nozzle also is relatively inefficient because it relies on what may be called "parallel flow" of liquid and air. As can be seen best in the front elevational view of part 15 of the Evans patent, which view is shown in FIG. 2 and labeled 15*a*, the air streams and liquid streams are introduced into the mixing chamber parallel to each other. In other words, the liquid stream is introduced through the center aperture in part 15, and air is introduced through the four apertures radially disposed from the center hole but opening parallel to it.

One general approach to increasing the efficiency of the atomization process in mixing chambers has been to provide so-called impingement surfaces. Air assisted atomizing spray nozzles comprising impingement surfaces are shown, e.g., in U.S. Pat. No. 4,899,937 to J. Haruch, U.S. Pat. No. 4,815,665 to J. Haruch, and U.S. Pat. No. 4,349,156 to J. Haruch. In general, these types of designs inject a liquid stream and an air stream into a mixing chamber perpendicular to each other with an impingement surface being situated at or near the point where the streams intersect.

While this can create considerable turbulence, thereby improving the atomization process, the nozzle is more complex because it incorporates impingement surfaces. Generally, additional parts must be fabricated in order to provide an impingement surface. The relative alignment of the air inlet, liquid inlet, and impingement surface also must be relatively precisely controlled. As a consequence, it is more difficult and costly to manufacture nozzles of this type.

OBJECTS AND SUMMARY OF THE INVENTION

An object of this invention, therefore, is to provide an air assisted atomizing spray nozzle which is more durable in use and is less susceptible to bending or breaking.

A further object of the subject invention is to provide an air assisted atomizing spray nozzle which is more easily and reliably manufactured.

Another object of the subject invention is to provide an air assisted atomizing spray nozzle wherein wear susceptible components of the nozzle may be made by casting processes.

Yet another object of the subject invention is to provide an air assisted atomizing spray nozzle which atomizes liquid more efficiently, thereby reducing the amount of air consumed.

It also is an object of the subject invention to provide an air assisted atomizing nozzle wherein all of the above mentioned advantages are realized.

The foregoing objects and advantages of the invention will be apparent to those skilled in the art upon reading the following detailed description and upon reference to the drawings.

Figure 1:
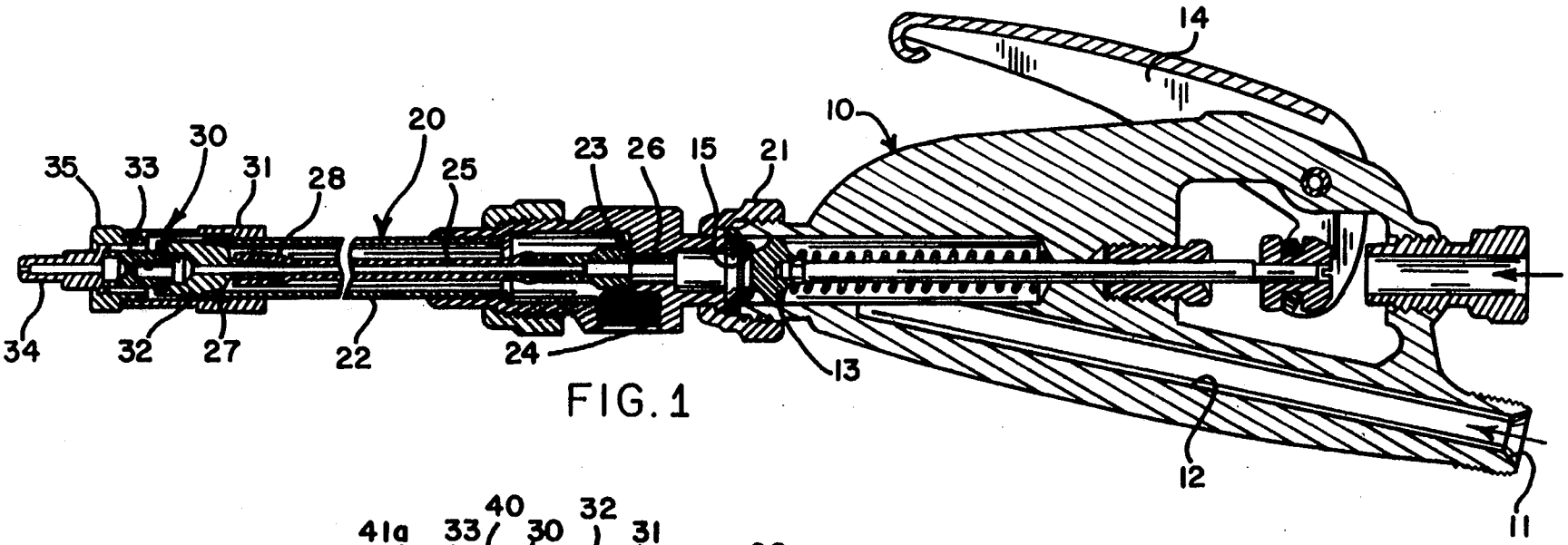
FIG. 1 is a longitudinal section of a hand held spray wand which incorporates a preferred embodiment of an air assisted atomizing spray nozzle of the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DESCRIPTION OF THE PREFERRED EMBODIMENTS

Figure 2:
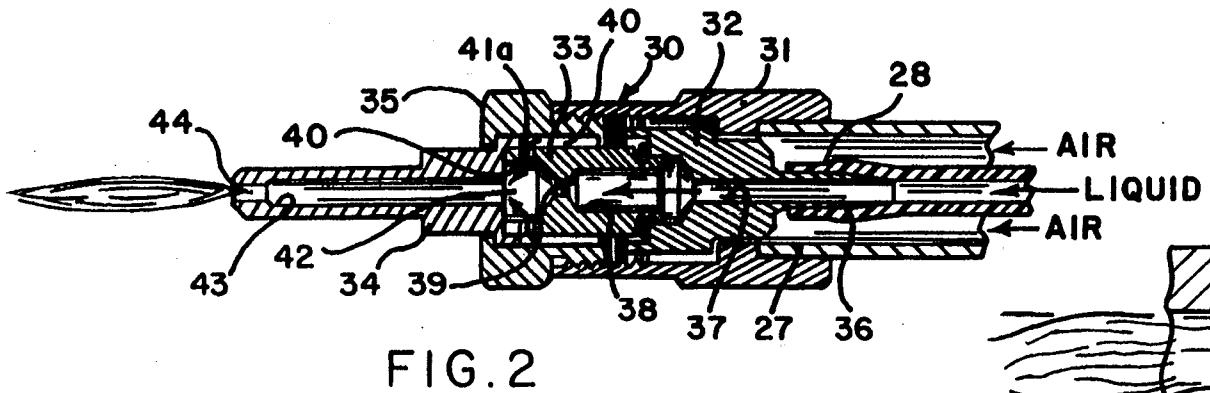
FIG. 2 is an enlarged, fragmentary, longitudinal cross-section of the tip end of the spray wand shown in FIG. 1, which shows in more detail the first preferred embodiment of the novel spray nozzle.
Figure 3:
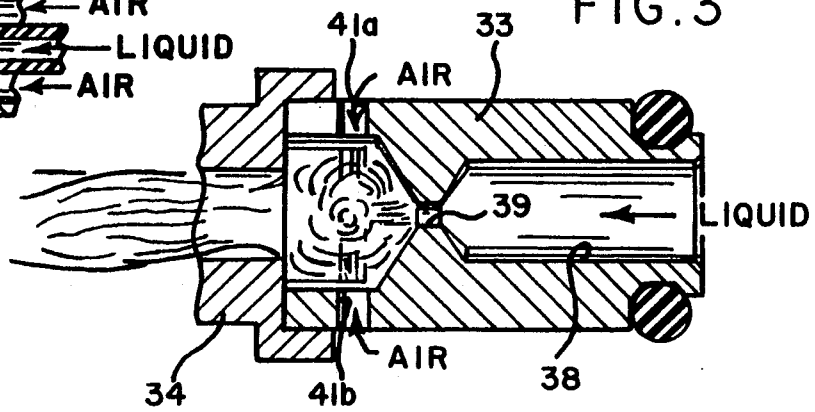
FIG. 3 is a further enlarged, partial cross-sectional view of certain components of the spray nozzle shown in FIGS. 1 and 2.

Referring now to FIGS. 1–3, there is shown an illustrative hand-held spray gun having a nozzle assembly in accordance with the present invention. This spray gun is constructed, except for incorporating the novel nozzle, substantially as described in the Evans patent discussed above. Accordingly, the text of that patent is incorporated in its entirety by this reference thereto.

The gun basically comprises three subassemblies: a handle assembly 10, a wand assembly 20, and a nozzle assembly 30. The handle assembly 10 is provided with a pressurized liquid inlet 11 adapted to connect, through a hose (not shown) with an external pressurized liquid reservoir (not shown). Liquid flows through a passageway 12 in the handle assembly 10 and is controlled by valve means 13 which is actuated by a handle 14. When the valve means 13 is open, liquid is transported through the passageway 12 in the handle assembly 10 and passes through an outlet 15 into the wand assembly 20.

The wand assembly 20 attaches to the outlet 15 of the handle assembly 10 via a lock nut 21. The wand assembly 20 comprises an outer tube 22 which has a sealed first end 23. The outer tube 22 is supplied with air via a pressurized inlet 24 which is adapted to connect, through a supply hose (not shown), with an external pressurized air source (not shown).

A capillary tube 25 is disposed within the outer tube 22. The capillary tube 25 has a first end 26 which passes through the sealed first end 23 of the outer tube 22 and communicates with the liquid outlet 15 in the handle assembly 10. The second end 27 of the outer tube 22 and the second end 28 of capillary tube 25 both communicate with the spray nozzle assembly 30, thereby permitting liquid and air to enter the spray nozzle assembly 30.

As can be seen best in FIG. 2, the spray nozzle assembly 30 comprises an internally threaded coupling 31, a connector 32, a an atomizing member 33, a spray tip 34, and an externally threaded lock screw 35. The threaded coupling 31 is suitably attached to the downstream end 27 of the outer tube 22. The nozzle assembly 30 may be assembled and disassembled by screwing and unscrewing the lock screw 35, thereby securing the atomizing member 30 upstream of the spray tip 34 and providing access to the other components of the nozzle assembly 30.

The connector 32 has a nipple 36 at its upstream end which is inserted into the downstream end 28 of the capillary tube 25, thereby providing means for connecting the nozzle assembly 30 to the capillary tube 25. A passageway 37 extends through the connector 32 to its downstream end, where a plurality of shoulders and o-rings provide means for sealably engaging the upstream end of the atomizing member 33 to the connector 32.

More particularly, the atomizing member 33 is generally cylindrical with its upstream end having a generally cylindrical projection of reduced external diameter. An annular channel is provided in the upstream projection of the atomizing member 33, in which is situated an o-ring. When assembled, the o-ring is compressed between opposing shoulders in the connector 32 and the atomizing member 33.

The atomizing member 33 is provided with a passageway 38 at its upstream end which, together with the handle passageway 12, capillary tube 25, and connector passageway 37 communicate liquid to a liquid injection port 39. Further, in order to accelerate the liquid prior to its injection into a mixing chamber 42 and to assist in the atomization of the liquid, the liquid injection port 39 defines a reduced diameter passageway. That is, the passageway 38 is a generally cylindrical bore which tapers inwardly at its downstream end into communication with the liquid injection port 39. The passageway 38 has a diameter approximately 2 to 3 times the diameter of the liquid injection port 39.

An air circulation chamber 40 is defined by a generally annular space which extends between the outer surfaces of the connector 32 and the atomizing member 33 and the inner surfaces of the nozzle housing, i.e., the threaded coupling 31 and the lock screw 35. The circulation chamber 40 communicates at its upstream end with the downstream end of the outer tube 22, thereby providing means for communicating air to a pair of air injection ports **41*a* and 41*b***.

The liquid injection port 39 and the air injection ports **41*a* and 41*b* all communicate with a mixing chamber 42. As is described in more detail below, liquid is atomized in the mixing chamber 42, and atomized liquid flows from the mixing chamber 42 through a passageway 43 in the spray tip 34 and is discharged through an exit orifice 44**.

The mixing chamber 42 is defined by a generally cylindrical bore in the downstream end of the atomizing member 33. The bore tapers outwardly from the downstream end of the liquid injection port 39. The mixing chamber 42 has a diameter approximately 12 to 13 times the diameter of the liquid injection port 39. The liquid injection port 39 is located in the atomizing member 33 at the upstream end of the mixing chamber 42 substantially along the longitudinal axis of the mixing chamber 42. Liquid introduced under pressure into the passageway 38 flows through the liquid injection port 39 and is injected axially as a stream into the mixing chamber The air injection ports 41*a* and 41*b* extend generally radially through the side walls of the atomizing member 33 providing radial communication between the air circulating chamber 40 and the mixing chamber 42. Preferably, the air injection ports 41 are located on diametrically opposed sides of the atomizing member 33. As a consequence, an opposing cross-flow of air is directed at the liquid stream as the liquid stream is injected into the mixing chamber 42. In other words, as can be seen best by the flow lines in FIG. 3, air is introduced under pressure into the circulation chamber 40 and flows through the air injection ports 41, thereby injecting a pair of air streams radially into the mixing chamber 42. Those air streams are substantially opposed to each other and are substantially perpendicular to the liquid stream injected into the mixing chamber.

If desired, an opposing cross-flow of air may be created by providing more than two air holes. For example, three openings could be provided spaced 120° apart, four openings could be provided spaced 90° apart, or more could be provided so long as the air streams created thereby substantially oppose each other and are substantially perpendicular to the liquid stream.

It will be appreciated that the novel nozzle assemblies, which utilize an opposing cross-flow arrangement, atomize the liquid stream more efficiently than prior art nozzles which use a parallel flow arrangement. In a parallel flow arrangement, atomization is dependent on differing velocities between the air streams and the liquid stream, a process which imparts relatively little direct force on the liquid stream. An opposing cross-flow arrangement exerts more direct shear force on the liquid stream and also creates more turbulence.

For example, a Gold Crest® Actisol® model pesticide applicator which is commercially available from Roussel Bio Corporation, Jacksonville, Fla., incorporates a spray gun which is constructed substantially as described in the previously mentioned Evans patent. The spray gun was modified so that it incorporates a novel nozzle assembly as described above. More particularly, the original mixing chamber part was replaced with an atomizing member made pursuant to the present invention as described above. The cylindrical bore of the substituted atomizing member, which substantially defines the mixing chamber, had a diameter of approximately 0.25" and a depth of approximately 0.50". The liquid injection port was an axially disposed hole measuring approximately 0.020" in diameter. The pair of radial air injection ports were holes measuring approximately 0.03125" in diameter which were located opposite each other. The wand is designed for liquid flow rates of approximately 1–2 gallons/hr. It was observed that this novel arrangement consumes air at the rate of approximately 0.5 standard cubic feet per minute. This is approximately 20–40% less than the air consumed by the commercially available model using the prior art mixing chamber part.

It will be appreciated by those skilled in the art that the optimum degree of atomization and flow rate of liquid depends on the particular application and system in which the nozzle will be used. Liquid atomization and flow rate are dependent on a variety of well known factors, including the viscosity of the liquid, the cross section of the air and liquid injection ports, the volume of space in the mixing chamber, and the configuration of the exit orifice in the spray tip. These factors may be varied by those of ordinary skill in the art to produce a desired degree of atomization and flow rate. All other factors being equal, however, it is believed that an opposing cross-flow of air provides relatively higher air efficiency, thereby decreasing air consumption.

It also will be appreciated that the atomizing member can be manufactured more easily and reliably. Fewer drillings are necessary to form the bore and injection ports in the atomizing member. Moreover, there are fewer drillings which require close tolerances and alignment of the air injection port is more easily accomplished. This design is relatively simple and has a minimum of parts, which can increase the economy of its manufacture and also lends itself to casting methods wherein more wear resistant materials, such as ceramics, may be used. It also should be appreciated that, being generally cylindrically shaped and lacking the perforated, annular disk-shaped structure which is part of the prior art, the atomizing member of the nozzle of the present invention is much more durable and less susceptible to bending or breaking.

Figure 4:
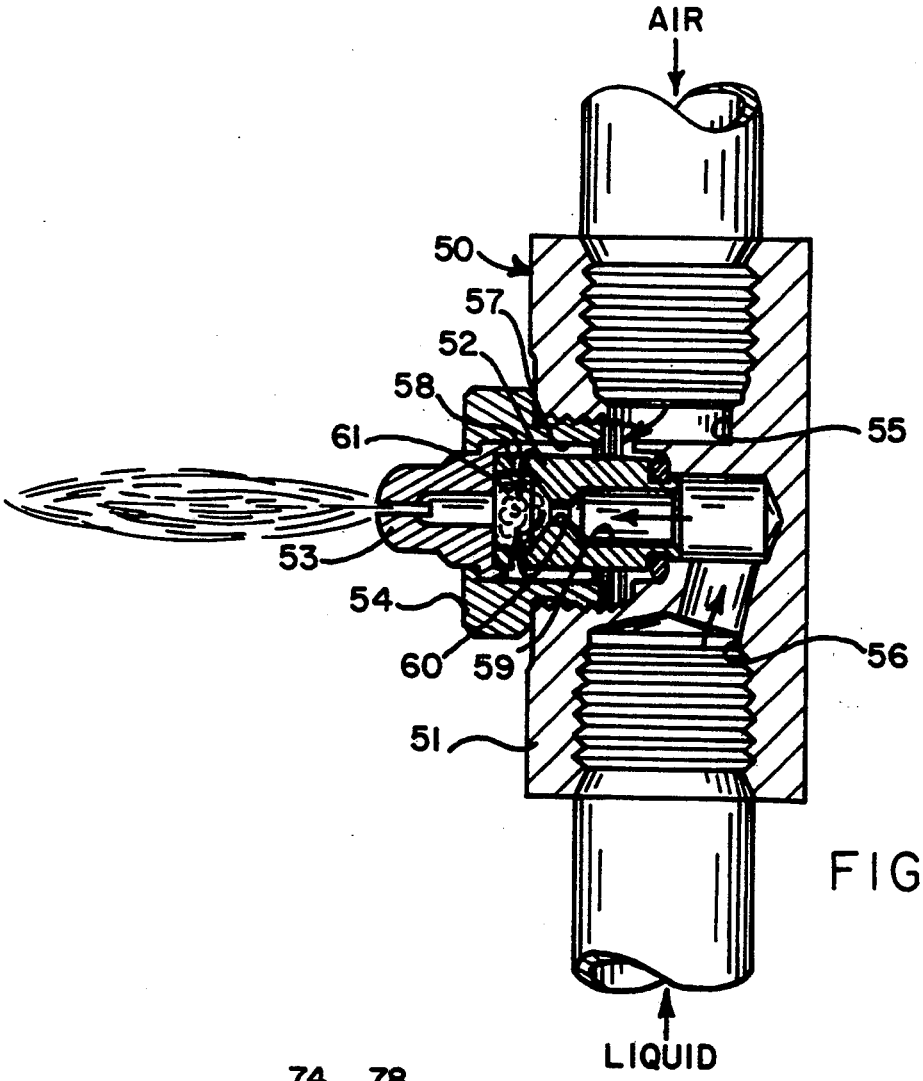
FIG. 4 is a side view, partially in section, of a second preferred embodiment of the novel air assisted atomizing spray nozzle.

A second preferred embodiment of the subject invention is shown in FIG. 4. This embodiment is an air assisted atomizing spray nozzle which is part of a more or less permanently installed system, such as may be used to humidify rooms in which paper is processed. The nozzle 50 comprises a body portion 51, a generally cylindrically shaped atomizing member 52, a spray tip 53, and a locking screw 54. The nozzle body 51 has a pressurized air inlet 55 and a pressurized liquid inlet 56.

In carrying out the invention, the atomizing member 52 of the second embodiment has a design identical to that of the atomizing member 33 discussed above in reference to the first embodiment, and otherwise the functioning of the nozzle 50 is substantially identical to that of the nozzle assembly 30. Air flows through a circulating chamber 57, which is defined by a generally annular space which extends between the outer surface of the atomizing member 52 and the inner surface of the locking screw 54, and then is injected through radial air injection ports 58 into a mixing chamber 61. Liquid is introduced through the pressurized liquid inlet 56, and ultimately flows through a passageway 59, which is generally cylindrical and tapers inwardly at its downstream end to a liquid injection port 60, thereby providing a reduced diameter passageway through which liquid is accelerated prior to injection into the mixing chamber 61. The diameter of the passageway 59 is approximately 2 to 3 times the diameter of the injection port 60.

The mixing chamber 61 is defined by a generally cylindrical bore in the downstream end of the atomizing member 52. The bore tapers outwardly from the downstream end of the liquid injection port 60. The diameter of the mixing chamber 61 is approximately 8 to 10 times the diameter of the liquid injection port 60. A liquid stream is injected axially into the mixing chamber 61 through the liquid injection port 60, where the stream is subjected to opposing cross air flows to finely atomize the liquid.

Figure 5:
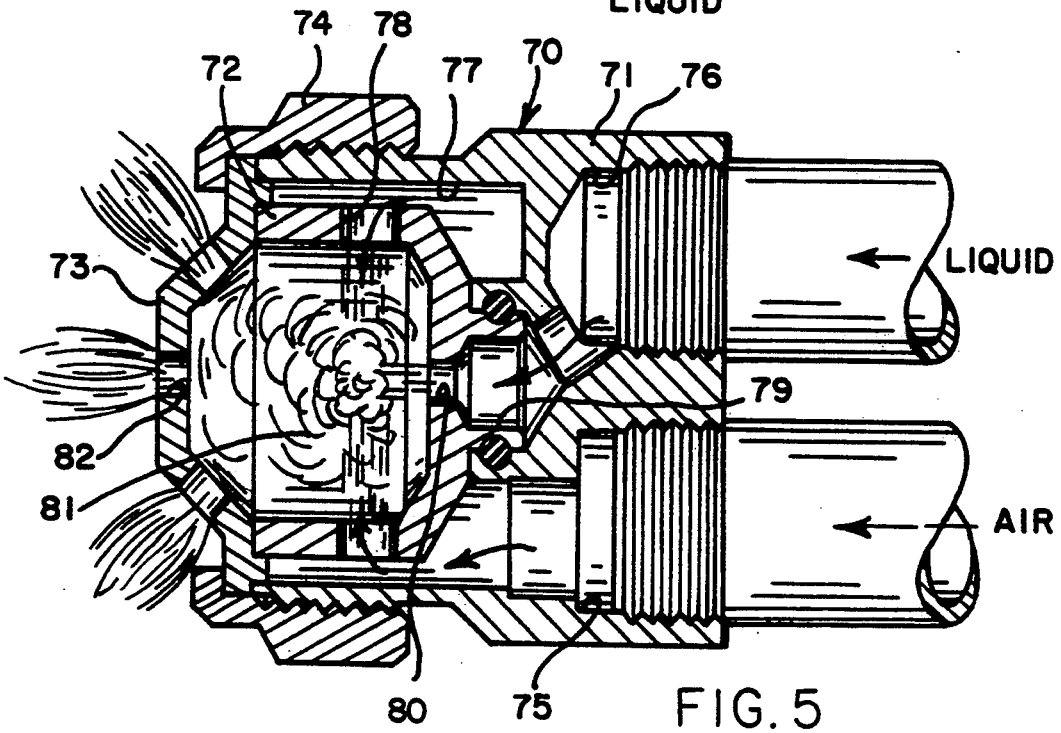
FIG. 5 is a side view, partially in section, of a third preferred embodiment of the novel air assisted atomizing spray nozzle.

A third preferred embodiment of the subject invention is shown in FIG. 5. This air assisted atomizing nozzle is especially suitable for spraying relatively large quantities of liquid, such as limestone slurry used in smoke stack scrubbing. The nozzle assembly 70 has a body portion 71, a generally cylindrically shaped atomizing member 72, a spray tip 73, and a locking nut 74. The nozzle body 71 has an air inlet 75 and a liquid inlet 76 coupled to respective supply lines.

The mixing chamber part 72 of this embodiment has substantially the same design as that shown in the previous embodiments, but it may be proportionately larger so that the spraying capacity of the nozzle may be increased. Air is introduced through the inlet 75, flows through a circulating chamber 77 which is defined by a generally annular space which extends between the outer surface of the atomizing member 72 and inner surfaces of a generally cylindrical bore in the body portion 71, and is injected through radial air injection ports 78 into a mixing chamber 81. Liquid is introduced through the inlet 76, and ultimately flows through a passageway 79, which is generally cylindrical and tapers inwardly at its downstream end to a liquid injection port 80, thereby providing a reduced diameter passageway through which liquid is accelerated prior to its injection into the mixing chamber 81. The diameter of the passageway 79 is approximately 2 to 3 times larger than that of the liquid injection port 80.

The mixing chamber 81 is defined by a generally cylindrical bore in the downstream end of the atomizing member 72. The bore tapers outwardly from the downstream end of the liquid injection port 80. The diameter of the mixing chamber 81 is approximately 6 to 7 times the diameter of the liquid injection port 80. A liquid stream is injected axially into the mixing chamber 81 through the liquid injection port 80. As with the other embodiments, the liquid stream is subjected to opposing cross-flow air streams in the mixing chamber 81. In order to vary the shape of the spray pattern, the spray tip 73 may have one or more exit orifices. For example, the spray tip 73 in this embodiment has a plurality of round orifices 82 to generate a wide angle round spray. It also may be provided with a single round orifice to produce a narrow angle round spray, or it may have one or more elliptical orifices to generate a flat spray pattern.

I claim:

1. An air assisted atomizing spray nozzle assembly comprising (a) a housing formed with a pressurized air inlet and a pressurized liquid inlet;

(b) a spray tip at a discharge end of said nozzle assembly;

(c) an atomizing member;

(d) means supporting said atomizing member in said housing upstream of said spray tip; and (e) said atomizing member defining (i) a mixing chamber having a longitudinal axis, (ii) a liquid injection port in axial communication with said mixing chamber for injecting a liquid stream axially into said mixing chamber, said mixing chamber being formed with a cylindrical portion having a diameter which is at least six times greater than the diameter of said liquid injection port and a tapered portion communicating between a down-stream end of said injection port and said cylindrical portion, and (iii) a plurality of air injection ports in radial communication through a cylindrical side wall of said mixing chamber cylindrical portion for injecting a plurality of air streams into said mixing chamber in substantially perpendicular relation to said liquid stream injected into said chamber for imparting shearing action on the liquid stream, turbulence and atomization of said liquid into fine droplets prior to discharge through said spray tip such that a fine liquid droplet spray pattern may be discharged from said spray tip without subsequent further pressurized air atomization.

2. The spray nozzle of claim 1 in which the diameter of said mixing chamber is approximately 6 to 10 times the diameter of said liquid injection port.

3. A hand-held spray gun comprising a handle section having a liquid inlet, a barrel section including an elongated tube mounted forwardly of said handle section, a nozzle section mounted at a forward end of said barrel section, liquid conduit means in said barrel section tube for communicating liquid from said liquid inlet to said nozzle section, said barrel section tube and liquid conduit means defining an air passageway through said barrel section communicating with said nozzle section, means defining a pressurized air inlet communicating with said air passageway, a trigger mounted on said handle section for movement between a deactuating position and an actuating position for permitting communication of liquid from said liquid inlet through said liquid conduit means to said nozzle section, said nozzle section including a spray tip, an atomizing member disposed upstream of said tip, said atomizing member defining (i) a mixing chamber having a cylindrical portion on a longitudinal axis and a tapered portion communicating between a downstream of said injection port and said cylindrical portion, (ii) a liquid injection port in axial communication with said mixing chamber for receiving liquid from said liquid conduit means and for injecting a liquid stream axially into said mixing chamber, said mixing chamber cylindrical portion having a diameter which is at least four times greater than the diameter of said liquid injection port, and (iii) a plurality of air injection ports in radial communication through a cylindrical side wall of said mixing chamber cylindrical portion and said air passageway for injecting a plurality of air streams radially into said mixing chamber for imparting shearing action on the liquid stream directed into said chamber and creating turbulence and atomization of said liquid into fine droplets prior to discharge through said spray tip such that a fine liquid droplet spray pattern may be discharged from said spray tip without subsequent further pressurized air atomization.

4. The spray gun of claim 3 in which said air injection ports are in aligned relation to each other on opposed sides of said mixing chamber for injecting said air stream radially into said mixing chamber in directions substantially opposed to one another and substantially perpendicular to said liquid stream.

5. A hand-held spray gun comprising a handle section having a liquid inlet, a barrel section including an elongated tube mounted forwardly of said handle section, a nozzle section mounted at a forward end of said barrel section, liquid conduit means in said barrel section tube for communicating liquid from said liquid inlet to said nozzle section, said barrel section tube and liquid conduit means defining an air passageway through said barrel section communicating with said nozzle section, means defining a pressurized air inlet communicating with said air passageway, a trigger mounted on said handle section for movement between a deactuating position and an actuating position for permitting communication of liquid from said liquid inlet through said liquid conduit means to said nozzle section, said nozzle section including a spray tip, an atomizing member disposed upstream of said tip, said atomizing member defining (i) a mixing chamber having a longitudinal axis, (ii) a liquid injection port in axial communication with said mixing chamber for receiving liquid from said liquid conduit means and for injecting a liquid stream axially into said mixing chamber, said mixing chamber having a diameter which is at least four times greater than the diameter of said liquid injection port, (iii) a liquid passageway communicating with said liquid injection port from an upstream end of said atomizing member, said liquid passageway having a diameter approximately 2 to 3 times larger than the diameter of said liquid injection port, and (iv) a plurality of air injection ports communicating between said mixing chamber and said air passageway for injecting a plurality of air streams radially into said mixing chamber for atomizing said liquid stream.

6. An air assisted atomizing spray nozzle assembly comprising (a) a housing formed with a pressurized air inlet and a pressurized liquid inlet;

(b) a spray tip at a discharge end of said nozzle assembly;

(c) an atomizing member;

(d) means supporting said atomizing member in said housing upstream of said spray tip; and (e) said atomizing member defining (i) a cylindrical mixing chamber having a longitudinal axis, (ii) a liquid injection port in axial communication with said mixing chamber and of smaller diameter than said mixing chamber for injecting an accelerated liquid stream axially into said mixing chamber, and (iii) a plurality of air injection ports in radial communication with said mixing chamber for injecting a plurality of air streams radially into said mixing chamber in substantially perpendicular relation to said liquid stream injected into said chamber for imparting shearing action on the liquid stream, turbulence and pre-atomization of said liquid into fine droplets;

(f) said spray tip having a flow passage of smaller diameter than that of said atomizing member mixing chamber for receiving pre-atomized liquid from said mixing chamber, and said spray tip having a discharge orifice smaller than the diameter of said spray tip passage for discharging a fine liquid droplet spray pattern from said spray tip without subsequent further pressurized air atomization.

7. The spray nozzle of claim 6 in which said air injection ports are in aligned relation to each other on opposed sides of said mixing chamber for injecting said air streams radially into said mixing chamber in directions substantially opposed to one another and substantially perpendicular to said liquid stream.

8. The spray nozzle of claim 7 in which said air injection ports are disposed in substantially equally spaced circumferential relation about said mixing chamber.

9. The spray nozzle of claims 6 in which said atomizing member and said housing define an air circulation chamber, and said air injection ports communicate between said air circulation chamber and said mixing chamber.

10. The spray nozzle of claim 6 in which said atomizing member has a liquid inlet passageway defined by a generally cylindrical bore in an upstream end thereof which bore tapers inwardly to said liquid injection port, and said mixing chamber is defined by a generally cylindrical bore in the downstream end of said atomizing member which bore tapers outwardly from said liquid injection port.

11. The liquid spray nozzle of claim 6 in which said atomizing member defines two air injection ports disposed on diametrically opposed sides of said atomizing member.

12. The spray nozzle of claim 10 in which atomizing member has a liquid inlet passageway communicating with said liquid injection port from an upstream end of said atomizing member, said liquid passage having a diameter approximately 2 to 3 times larger than the diameter of said liquid injection port.

13. The spray nozzle of claim 6 including a releasable retaining member for releasably securing said spray tip in mounted relation adjacent an downstream end of said atomizing member, and said retaining member and atomizing member define an annular air chamber communicating with said air injection ports.

14. The spray nozzle of claim 6 in which said housing is an elongated block which supports said atomizing member intermediate its ends, and said air inlet being formed in one end of said block and said liquid inlet being formed in an opposite end of said block.

15. The spray nozzle assembly of claim 14 in which said housing and atomizing member define an annular air chamber communicating with said air injection ports.

16. The spray nozzle assembly of claim 6 in which said spray tip flow passage defines a sharp edge about an upstream end thereof.

17. The spray nozzle assembly of claim 6 in which said atomizing member mixing chamber has a diameter which is at least six times greater than the diameter of said liquid injection port.

18. A hand-held spray gun comprising a handle section having a liquid inlet, a barrel section including an elongated tube mounted forwardly of said handle section, a nozzle section mounted at a forward end of said barrel section, liquid conduit means in said barrel section tube for communicating liquid from said liquid inlet to said nozzle section, said barrel section tube and liquid conduit means defining an air passageway through said barrel section communicating with said nozzle section, means defining a pressurized air inlet communicating with said air passageway, a trigger mounted on said handle section for movement between a deactuating position and an actuating position for permitting communication of liquid from said liquid inlet through said liquid conduit means to said nozzle section, said nozzle section including a spray tip, an atomizing member disposed upstream of said tip, said atomizing member defining (i) a mixing chamber having a longitudinal axis, (ii) a liquid injection port in axial communication with said mixing chamber and of smaller diameter than said mixing chamber for receiving liquid from said liquid conduit means and for injecting an accelerated liquid stream axially into said mixing chamber, and (iii) a plurality of air injection ports in radial communication with said mixing chamber and said air passageway for injecting a plurality of air streams radially into said mixing chamber for imparting shearing action on the liquid stream directed into said chamber and creating turbulence and pre-atomization of said liquid into fine droplets, said spray tip having a flow passage of smaller diameter than that of said atomizing member mixing chamber for receiving pre-atomized liquid from said mixing chamber, and said spray tip having a discharge orifice smaller than the diameter of said spray tip passage for discharging a fine liquid droplet spray pattern from said spray tip without subsequent further pressurized air atomization.

19. An air assisted atomizing spray nozzle assembly comprising (a) a housing formed with a pressurized air inlet and a pressurized liquid inlet;

(b) a spray tip at a discharge end of said nozzle assembly;

(c) an atomizing member;

(d) said atomizing member defining (i) a cylindrical mixing chamber having a longitudinal axis, (ii) a liquid injection port in axial communication with said mixing chamber for injecting an accelerated liquid stream axially into said mixing chamber, said mixing chamber having a diameter which is at least six times greater than the diameter of said liquid injection port and (iii) a plurality of air injection ports in radial communication with said mixing chamber for injecting a plurality of air streams radially into said mixing chamber in substantially perpendicular relation to said liquid stream injected into said chamber for imparting shearing action on the liquid stream, turbulence and pre-atomization of said liquid into fine droplets, and (e) said spray tip being mounted downstream of said atomizing member for receiving pre-atomized liquid from said mixing chamber and being formed with a discharge orifice having a flow passage area less than the area defined by the diameter of said atomizing member mixing chamber for discharging a fine liquid droplet spray pattern from said spray tip without subsequent further pressurized air atomization.

* * * * *